US007621093B2

(12) United States Patent
Thiers et al.

(10) Patent No.: US 7,621,093 B2
(45) **Date of Patent: *Nov. 24, 2009**

(54) FLOOR COVERING, FLOOR PANEL AND SET OF FLOOR PANELS FOR FORMING SUCH FLOOR COVERING AND METHODS FOR THE PACKAGING AND MANUFACTURING OF SUCH FLOOR PANELS

(75) Inventors: Bernard Paul Joseph Thiers, Oostrozebeke (BE); Lode Hubert Lieven De Boe, Moorslede (BE); Luc Dirk Daniël Vanhastel, Tielt (BE)

(73) Assignee: Flooring Industries Ltd., Dublin (IE)

( * ) Notice: Subject to any disclaimer, the term of this patent is extended or adjusted under 35 U.S.C. 154(b) by 563 days.

This patent is subject to a terminal disclaimer.

(21) Appl. No.: 11/249,591

(22) Filed: Oct. 14, 2005

(65) Prior Publication Data

US 2006/0026923 A1 Feb. 9, 2006

Related U.S. Application Data

(63) Continuation of application No. 10/753,453, filed on Jan. 9, 2004.

(60) Provisional application No. 60/438,781, filed on Jan. 9, 2003.

(30) Foreign Application Priority Data

Jan. 9, 2003 (BE) ..... 2003/0020

(51) Int. Cl.
*E04B 5/00* (2006.01)

(52) U.S. Cl. ..... 52/588.1; 52/796.1; 52/841; 52/578

(58) Field of Classification Search ..... 52/313–314, 52/384–388, 390, 589.1, 591.4, 592.1, 783.1, 52/796.1, 309.4, 578–592.6; 427/369; 428/47, 428/48, 195.1, 285, 143, 148, 204, 211, 532, 428/535, 167, 537.5
See application file for complete search history.

(56) References Cited

U.S. PATENT DOCUMENTS

| | | | | |
|---|---|---|---|---|
| 753,791 | A | 3/1904 | Fulghum | |
| 2,184,113 | A * | 12/1939 | Calafati | 165/56 |
| 2,666,233 | A * | 1/1954 | Klemm | 52/263 |
| 3,641,730 | A * | 2/1972 | Meckstroth | 52/586.2 |
| 4,471,012 | A | 9/1984 | Maxwell | |
| 4,479,333 | A * | 10/1984 | Hendrich | 52/70 |
| 4,538,392 | A | 9/1985 | Hamar et al. | |
| 5,113,632 | A | 5/1992 | Hanson | |
| 5,755,068 | A * | 5/1998 | Ormiston | 52/314 |

(Continued)

FOREIGN PATENT DOCUMENTS

EP 1 024 234 A2 8/2000

(Continued)

*Primary Examiner*—Jeanette Chapman
(74) *Attorney, Agent, or Firm*—Bacon & Thomas, PLLC

(57) ABSTRACT

Floor covering, of the type consisting of the type consisting of oblong, and more particularly rectangular, strip-shaped hard floor panels with a layered structure, which extend in parallel rows, characterized in that it comprises floor panels of at least two different lengths, whereby these different lengths are realized at the manufacturer's.

9 Claims, 4 Drawing Sheets

U.S. PATENT DOCUMENTS

| | | | | |
|---|---|---|---|---|
| 6,256,952 | B1 * | 7/2001 | Fahy et al. | 52/263 |
| 6,330,980 | B1 * | 12/2001 | Fiedrich | 237/69 |
| 6,440,538 | B1 * | 8/2002 | Ungar | 428/195.1 |
| 6,691,480 | B2 * | 2/2004 | Garcia | 52/313 |
| 6,786,019 | B2 * | 9/2004 | Thiers | 52/589.1 |
| 6,863,768 | B2 * | 3/2005 | Haffner et al. | 156/304.1 |
| 6,874,292 | B2 * | 4/2005 | Moriau et al. | 52/590.2 |
| 6,922,965 | B2 * | 8/2005 | Rosenthal et al. | 52/592.1 |
| 6,931,811 | B2 * | 8/2005 | Thiers | 52/592.1 |
| 2002/0014047 | A1 | 2/2002 | Thiers | |

FOREIGN PATENT DOCUMENTS

| | | | |
|---|---|---|---|
| EP | 1 308 577 | A2 | 5/2003 |
| EP | 1 437 456 | A1 | 7/2004 |
| FR | 2 630 149 | | 10/1989 |
| WO | 97/47834 | | 12/1997 |
| WO | 01/02672 | A1 | 1/2001 |
| WO | WO 01/96688 | A1 | 12/2001 |
| WO | 02/25004 | A2 | 3/2002 |
| WO | WO 03/089736 | A1 | 10/2003 |

* cited by examiner

FLOOR COVERING, FLOOR PANEL AND SET OF FLOOR PANELS FOR FORMING SUCH FLOOR COVERING AND METHODS FOR THE PACKAGING AND MANUFACTURING OF SUCH FLOOR PANELS

RELATED APPLICATION DATA

This application is a continuation application of pending U.S. application Ser. No. 10/753,453, filed on Jan. 9, 2004, which claims the benefit of U.S. provisional application No. 60/438,781, filed on Jan. 9, 2003, and further claims the benefit of Belgian patent application no. 2003/0020, filed Jan. 9, 2003.

BACKGROUND OF THE INVENTION

A. Field of the Invention

This invention relates to a floor panel, as well as a floor panel and a set of floor panels for forming such floor covering, as well as to a method for packaging such floor panels and methods for manufacturing them.

More particularly, the invention is intended for use with floor panels with a layered structure, which are manufactured of a larger plate having such layered structure, however, certain aspects of the invention can also be applied more generally, in other words, with floor panels having another structure.

By floor panels with a layered structure, in the first place traditional laminated panels are meant, which, as is known, comprise at least one core layer and a top layer, whereby the core layer, for example, consists of MDF, HDF, particle board, so-called compact laminate or the like, whereas the top layer, for example, consists of different sheets of material pressed on top of each other, such as layers or paper soaked in resin, amongst which a printed decorative layer. Floor panels with another layered structure, however, are not excluded, for example, whereby the top layer consists of cork, veneer, a relatively thick layer of wood, and so on, or whereby the floor panels are provided with special intermediate layers, such as a sound-damping layer or such.

B. State of the Art

Traditionally, such floor panels are made of boards having a width in the order of magnitude of 20 cm and a length of approximately 120 cm. Such known floor panels have the disadvantage that in installed condition, a plate-like appearance will prevail which appears unnatural, particularly if the intention is to represent a parquetry pattern with oblong laths, or when if the intention is to imitate a "plank floor."

In order to obtain a more irregular and natural appearance, it is known to make use of oblong floor panels of two different widths, whereby then, for example, alternately one row of wide floor panels and one row of narrow floor panels are laid. As, when installing the floor covering, however, in many cases one will always start with a complete or half a panel per row, still a certain regularity will pertain in the formed pattern, as a consequence of which the appearance still remains rather unnatural.

It is also known for special applications to insert a number of shorter floor panels in between longer ones, whereby in fact it is not intended to remedy the unnatural appearance, but to create special effects, such as, for example, tile-shaped insertions in a floor covering with a parquetry pattern.

BRIEF SUMMARY OF THE INVENTION

The present invention aims at a technical solution in order to arrive at a floor covering consisting of oblong, as well as strip-shaped, hard floor panels, whereby an improvement is offered which allows to obtain a further minimization of the unnatural appearance. The invention also aims at a solution which is suitable for application in a mass production, such with a minimum of possible additional costs in respect to the classically applied manufacturing processes.

To this aim, the invention in first instance relates to a floor covering of the type consisting of oblong, and more particularly rectangular, strip-shaped hard floor panels with a layered structure, said panels extending in parallel rows, with the characteristic that this floor covering comprises floor panels of at least two different lengths, whereby these different lengths are realized at the manufacturer's. As floor panels of different lengths are present in the floor covering, said regularity is interrupted, which contributes to a natural appearance.

As the floor panels are made by the manufacturer, the use, more particularly the floorer, also obtains the possibility of mixing the floor panels at random, as a consequence of which the irregularity can be accentuated even more. Also, the user or the floorer obtains the possibility of performing a selection among the different lengths when laying each subsequent panel, thereby not only obtaining the possibility of influencing the appearance, but also of choosing and arranging floor panels in function of the length of one row to be installed, such that the volume of waste, more particularly short remainders which one rather would not use in a subsequent row, can be restricted to a minimum.

The invention is particularly useful with floor panels having a wood and/or parquetry pattern at their upper surface, and in particular with floor panels which each are provided with one continuous wood pattern over the entire surface of the respective floor panel, in other words, floor panels in which the pattern represents one plank.

It is obvious that said floor panels of different lengths preferably have the same width. However, the floor covering also may comprise floor panels of different widths, whereby then, preferably, different lengths are provided per floor panel width.

Herein, it is also clear that the floor panels preferably are intended for realizing a floor covering of the type in which all or substantially all floor panels extend lengthwise in parallel rows, and as such imitate a plank floor or imitate a parquetry floor consisting of plank-like members, in which all or substantially all floor panels are of one and the same type, namely oblong and rectangular, contrary to different lengths which are applied for forming floor coverings in which the floor panels represent a fancy pattern or different lengths for forming so-called friezes.

From the above-said, as well as from the following description of several embodiments, it is clear that by means of "different lengths realized at the manufacturer's" in particular pre-determined or well-defined lengths are meant, and still more particularly a limited number of standard lengths, which are determined by the manufacturer. In other words, the invention in first instance does not relate to "different lengths obtained at random", whether or not varying according to a preset increment, as, for example, described in U.S. Pat. Nos. 4,471,012 and 5,113,632 for wood or veneer. More particularly, contrary to what is disclosed in these documents, the present invention does not relate to non-specified different lengths which are obtained as the result of a sorting process of wood remainders.

Furthermore, it is also clear that the invention relates to floor panels which in their final commercial form are of different length, and not to floor panels which themselves are composed of parts which are of different length, such as disclosed in U.S. Pat. Nos. 753,791 or 5,113,632.

Moreover, panels of different lengths are meant which can be installed at random, contrary to for example supplemental panels of half a length which are only intended to be installed at the beginning or end of a row, such as disclosed in U.S. Pat. No. 4,538,392.

The invention is particularly advantageous in case of floor panels which are industrially made from large plates which are cut, more particularly sawn, into such panels.

Preferably, said floor panels each are provided with mechanical coupling parts at their four edges. It is also preferred that the coupling parts at least at two opposite edges of each floor panel, and preferably at both pairs of opposite edges, are realized such that, when realizing a coupling with an adjoining floor panel, a locking in vertical as well as horizontal directions is obtained. By "vertical direction", hereby a direction perpendicular to the respective coupled sides or edges of the floor panels and parallel to the plane of the floor covering is meant.

It is also preferred that the coupling parts for all intended panels are arranged in an identical manner around the peripheral edges of the panels.

In a preferred from of embodiment, the floor covering comprises floor panels of at least three different lengths, which lengths are realized at the manufacturer's, resulting in that the aforementioned technical advantages are underlined.

In a practical form of embodiment, the floor covering is characterized in that, at least for the floor panels of a certain width, the floor panels having the largest length are present in a larger number than the floor panels of another certain length, in order to obtain that the number of floor panels to be laid in order to cover a certain floor surface, regardless of the fact that shorter floor panels are used, too, still remains limited, thereby reducing the installation costs.

Further, it is preferred that at least the floor panels of the largest length have a length being at least eight times, and even better ten times, the width of these panels. As a matter of fact, the invention shows its advantages in particular in combination with such oblong floor panels.

Of course, the invention also relates to floor panels, with the characteristic that these floor panels allow to form a floor covering according to the invention.

It also relates to a set of floor panels, with the characteristic that it consists of floor panels of at least two different lengths which allow to form at least a part of a floor covering being in accordance with the invention.

According to a particular characteristic, such set of floor panels is packaged in one and the same package, more particularly in one and the same packaging box. Hereby is obtained that the user, and in particular the floorer, when opening each new package, automatically has floor panels of at least two different lengths at his disposal. This also results in that, when the floor panels substantially are installed as they are available from successively opened packages, it is automatically guaranteed that a sufficient mixture between floor panels of different lengths is obtained in the floor covering.

This manner of packaging also offers the advantage that a distributor must have less ample stocks. If the floor panels of different lengths were sold in separate boxes, indeed certain lengths might be sold more often than other lengths, which is difficult to anticipate for the distributor and, as a consequence thereof, he would be obliged to provide a large stock of floor panels of each length, whereas with packages in which the floor panels are already mixed, such stock in total can be kept smaller.

In case that different lengths are available for forming a well-defined floor covering, even if there are more than two different lengths, it is preferred that those are packaged such that they are evenly distributed over the various packages and that each package contains floor panels of each length.

It is noted that packaging floor panels of different lengths in this manner also is advantageous with other floor panels, whether they have a layered structure or not, thus, also with massive floor panels or flooring parts. According to an independent aspect, the present invention thus also relates to a method for packaging floor panels, with the characteristic that floor panels are concerned consisting of rectangular oblong strip-shaped hard floor panels which are intended for forming a floor covering comprising floor panels which are fabricated, at the manufacturer's, in at least two lengths, and that, when packaging them, floor panels of different lengths are provided in one and the same package, more particularly in one and the same box.

Preferably, the floor panels are packaged such that each package contains floor panels which allow to cover precisely a well-defined surface. As a result, it is excluded that the buyer of such floor panels must determine for himself how many floor panels of one length and floor panels of the other length he needs. By the mixed packaging, and due to the fact that each package contains floor panels which allow to cover one and the same surface, the buyer simply can determine the number of packages to buy, more particularly of boxes with floor panels, by dividing the overall floor surface by the number of square meters present in one box or the like.

Preferably, the floor panels are stacked flat in a box, whereby they are provided therein in such a manner that they never can tilt in a horizontal position of the box, which, as will be explained in the following description, offers various advantages.

Further, the invention also relates to a method for manufacturing floor panels for forming said floor covering, with the characteristic that it consists in forming plates with a layered structure and sawing those plates into rectangular oblong strip-shaped floor panels of at least two different lengths, whereby during manufacturing, also coupling parts are formed at the edges thereof.

BRIEF DESCRIPTION OF THE DRAWINGS

With the invention of better showing the characteristics of the invention, hereafter, as an example without any limitative character, several preferred forms of embodiment are described, with reference to the accompanying drawings, wherein.

DETAILED DESCRIPTION OF VARIOUS EMBODIMENTS

Figure 1:
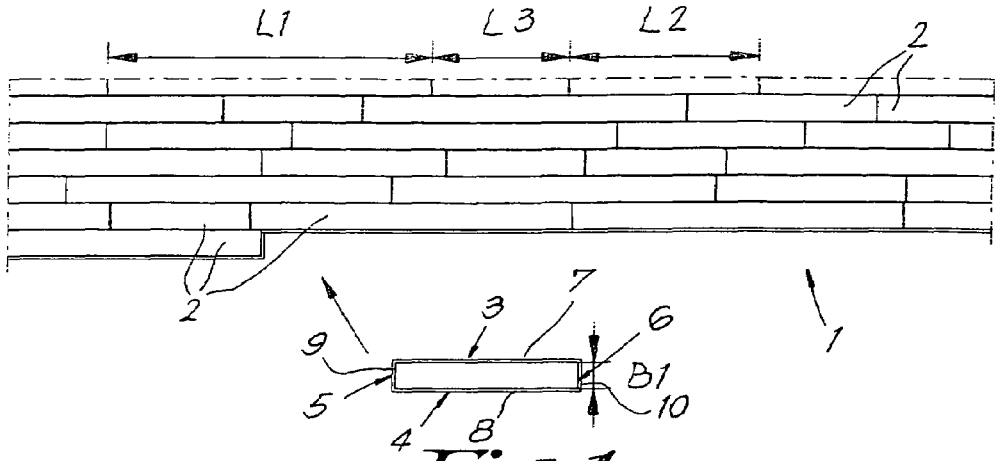
FIG. 1 schematically represents a floor covering according to the invention.

As shown in FIG. 1, the invention relates to a floor covering 1, of the type consisting of oblong, and more particularly rectangular, strip-shaped hard floor panels 2 with a layered structure, which panels extend in parallel rows, with the particularity that this floor covering 1 comprises floor panels 2 of at least two different lengths, whereby these different lengths are realized at the manufacturer's. In the given example, even three different lengths of floor panels 2 are applied, as indicated by L1, L2 and L3, respectively.

As aforementioned, these floor panels 2 preferably have a sole continuous wood pattern at their upper surface, which pattern is not represented in FIG. 1.

At the edges or sides 3-4-5-6 of the floor panels 2, coupling parts 7-8-9-10 are formed which allow that such floor panels 2 can be mutually coupled in a mechanical manner. Preferably, these coupling parts 7-8-9-10 are realized such that they offer a locking in vertical as well as horizontal directions. Such coupling parts are known in themselves in various forms, amongst others, from WO 97/47834, and hereby coupling parts may be concerned which allow ajoining of floor panels 2 according to different possibilities, for example, by shifting the floor panels 2 towards each other, whereby these coupling parts engage into each other by means of a snap effect, by turning the floor panels 2 into each other, or by joining them vertically.

Figure 2:
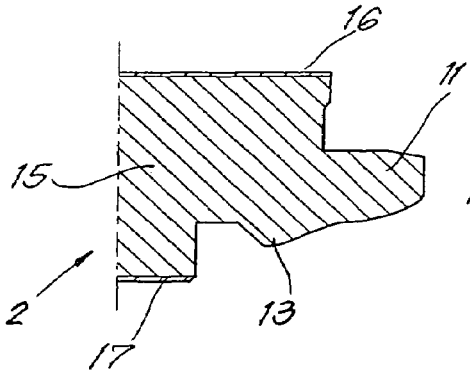
FIGS. 2 and 3 represent possible forms of embodiment of coupling parts which can be applied to the floor panels of the floor covering of FIG. 1.
Figure 3:
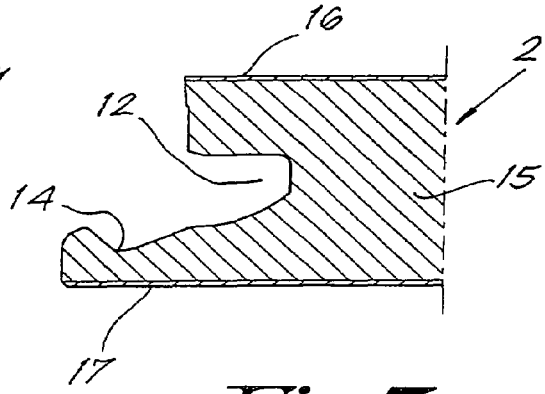

For example, the coupling parts 7 and 9 might be realized as illustrated in FIG. 2, whereas the coupling parts 8 and 10 can be realized as illustrated in FIG. 3. As represented in FIGS. 2 and 3, preferably coupling parts shall be used in the form of a tongue 11 and a groove 12 with locking parts 13 and 14 providing for a locking in horizontal direction.

Figure 4:
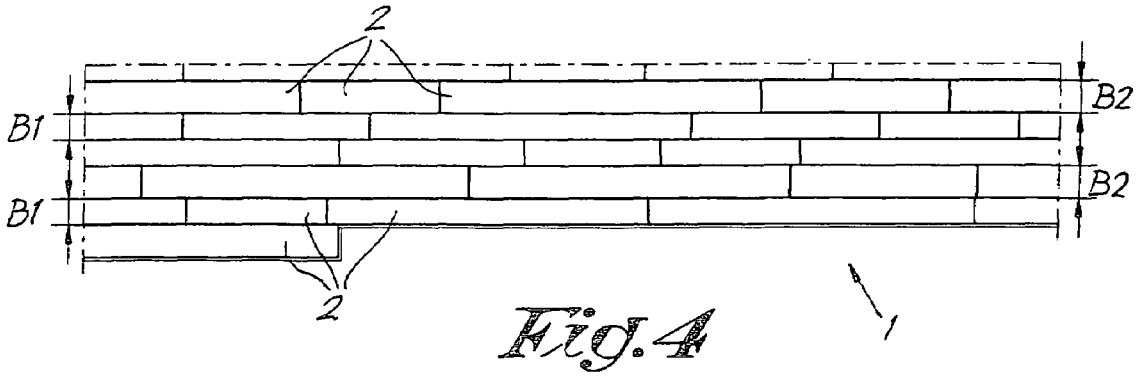
FIG. 4 represents a variant of a floor covering according to the invention.

In the embodiment of FIG. 1, all floor panels 2 have one and the same width B1. According to a variant, one may also work with different widths. FIG. 4 represents an example thereof, whereby use is made of floor panels 2 of two widths B1 and B2, whereby for each width B1-B2 floor panels 2 of different lengths are available.

It is noted, that preferably, in general a well-defined ratio of numbers of floor panels 2 of different lengths is applied, although this is not really necessary. So, for example, as an average, for eight floor panels 2 of the length L1, four of the length L2 and four of the length L3 can be applied.

Of course, the values of L1, L2, L3, B1 and B2 can be freely chosen by the manufacturer. A practical, non-restrictive example are values L1=140 cm, L2=80 cm, L3=60 cm, B1=8 to 12 cm and B2=10 to 14 cm.

The floor panels 2 preferably are laminated panels, more particularly panels formed, at least at their upper side, of one or more layers soaked in resin-in other words layers impregnated with resin or layers carrying resin-, more particularly paper layers, and pressed on top of each other and/or applied onto a core or substrate, amongst which layers of a printed decorative layer is present. As illustrated in FIGS. 2 and 3, such floor panels 2 then preferably consist of a core 15 of MDF, HFD, particle board or such, which is provided with a top layer 16 and a backing layer 17, whereby the top layer 16 comprises said decorative layer.

Figure 5:
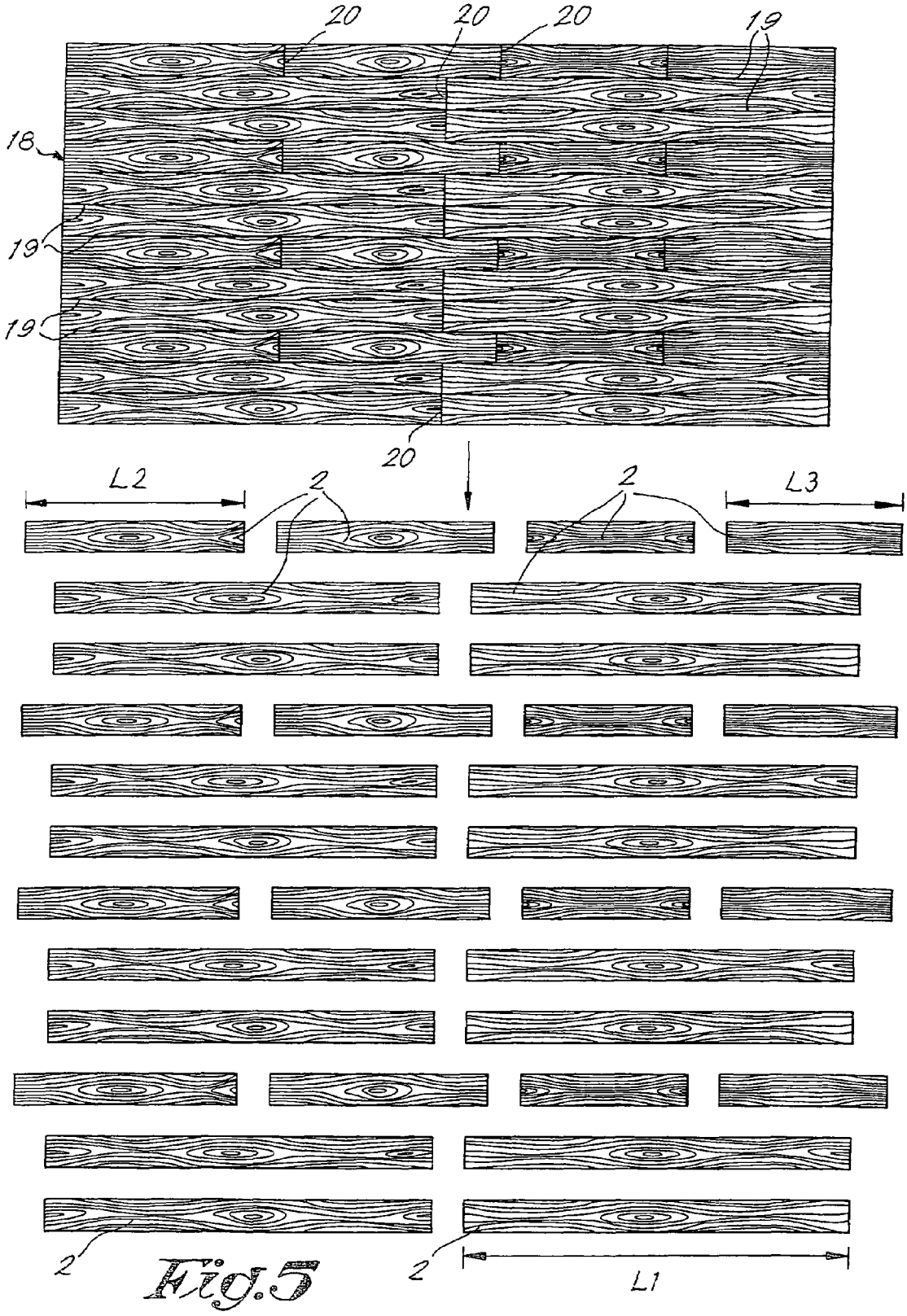
FIGS. 5 to 7 relate to different techniques for manufacturing floor panels according to the invention.
Figure 6:
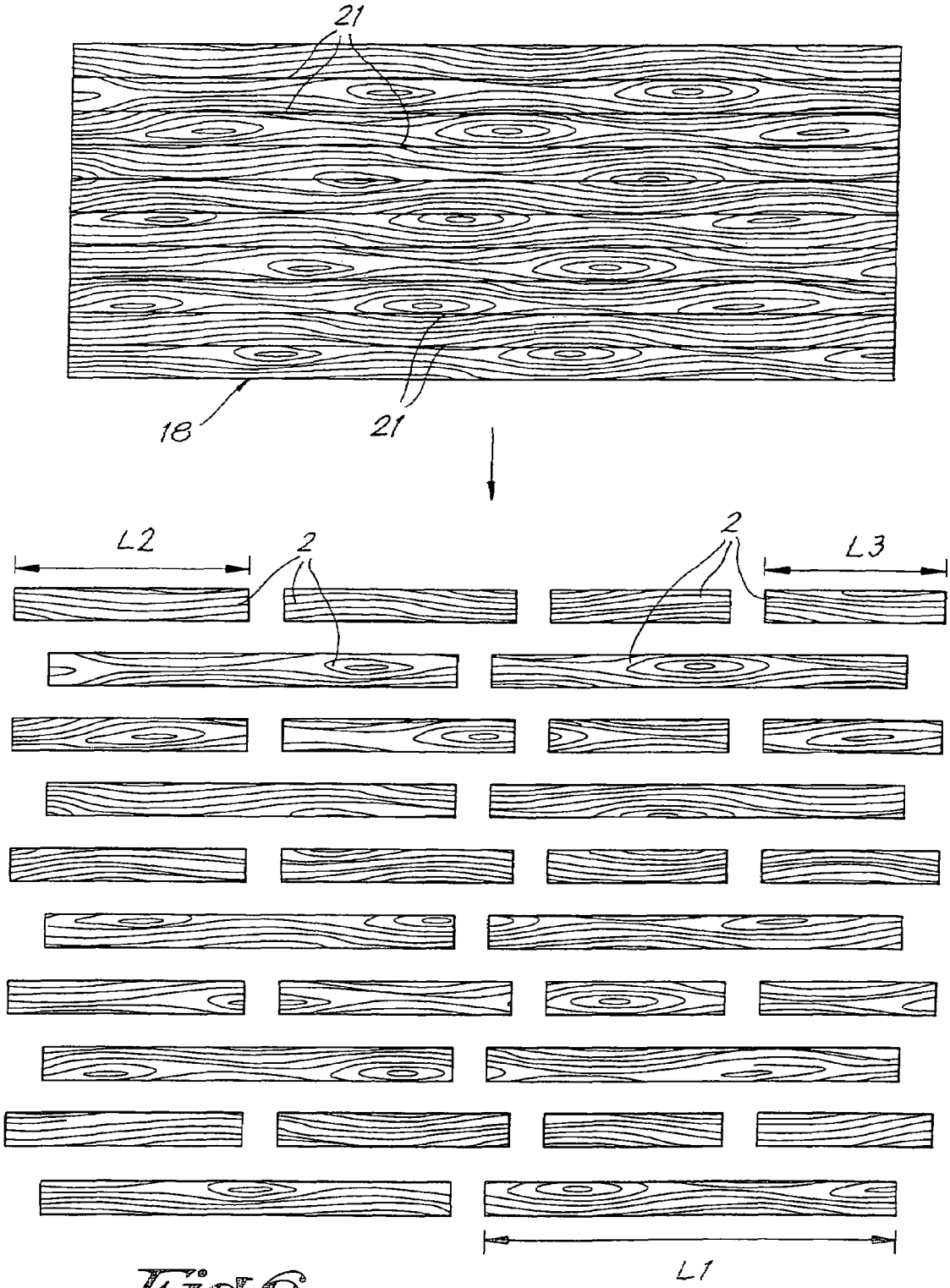

As schematically represented in FIGS. 5 and 6, said floor panels 2 preferably are manufactured by forming plates 18 with a layered structure and subsequently sawing these plates 18 into rectangular oblong strip-shaped floor panels 2 of at least two different lengths, whereby during manufacturing, also the respective coupling parts 7-8-9-10 are formed at the edges 3-4-5-6 thereof.

The manufacture of the plates 18 may be performed according to all techniques known to this end up to the present, or also in any other manner allowing to form a composed plate 18.

As also represented in FIGS. 5 and 6, it is preferred that floor panels 2 of different lengths, in this case said lengths L1, L2 and L3, are manufactured of one and the same plate 18.

Such plate 18 can be provided with a pattern, more particularly a wood pattern, in different manners and can be sawn into floor panels 2.

According to the form of embodiment represented in FIG. 5, the plate 18 is provided with separate patterns per floor panels 2 to be formed, after which the plate 18 is sawn into floor panels 2 in function of the borderlines 19-20 of those patterns. An advantage thereof is that the patterns can be realized such that, when two floor panels 2 are placed one after the other, they will never render the impression that the patterns precisely merge into each other.

According to the form of embodiment represented in FIG. 6, the plate 18 is provided with patterns continuing at least in the longitudinal direction of the floor panels 2 to be formed, and the plate 18 is sawn into floor panels 2 of the desired lengths. This technique then has the advantage that the transverse cuts can be realized at any location, as they are not depending on transitions or borderlines 20 between two patterns, such as this is the case in FIG. 5. In this manner, starting from one and the same overall pattern for a plate 18, floor panels 2 showing lengths according to choice can be manufactured from such plates. This, for example, allows that the manufacturer, when he desires so, can exclusively produce floor panels 2 of length L1, whereas he still can switch at any moment to the production of, for example, floor panels 2 of the lengths L1, L2, as well as L3, without the necessity of choosing another overall pattern for the plate 18. In this manner, also the possibility is given to manufacture the floor panels 2 of lengths L1 from certain plates 18, whereas the floor panels 2 of lengths L2 and L3 are produced from other plates 18, without the necessity of having different overall patterns for the plate 18 available.

According to a not represented variant, the plate 18 can be provided with a continuous pattern, more particularly a wood pattern, over its entire surface, after which the plate 18 is sawn into floor panels 2 of the desired lengths. This means that there are no more borderlines 21 in the overall pattern, as this is the case in FIG. 6. This allows for that, starting from one and the same overall pattern, floor panels 2 of different widths can be manufactured therefrom at random.

Figure 7:
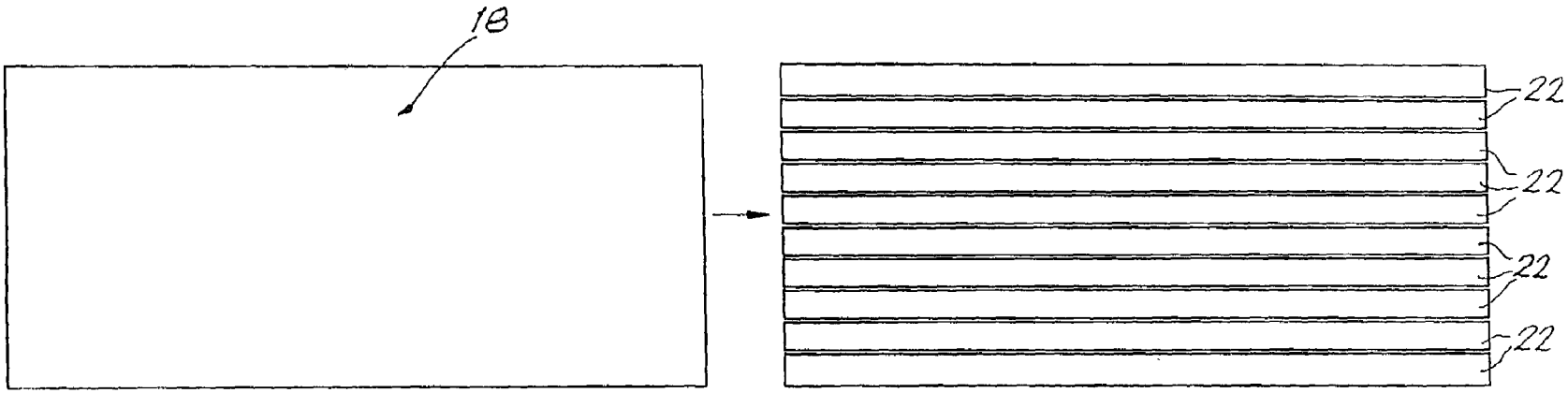

As schematically represented in FIG. 7, the plates 18, according to a well-defined form of embodiment of the method for their manufacture, first can be divided into strips 22, more particularly sawn into strips 22, subsequently coupling parts 7-8 can be formed at the long sides 3-4 of these strips 22, and only thereafter the floor panels 2 of different lengths, for example, L1-L2-L3, can be formed, after which coupling parts 9-10 then can be formed at the short sides 5-6 of the floor panes 2, too.

Figure 8:
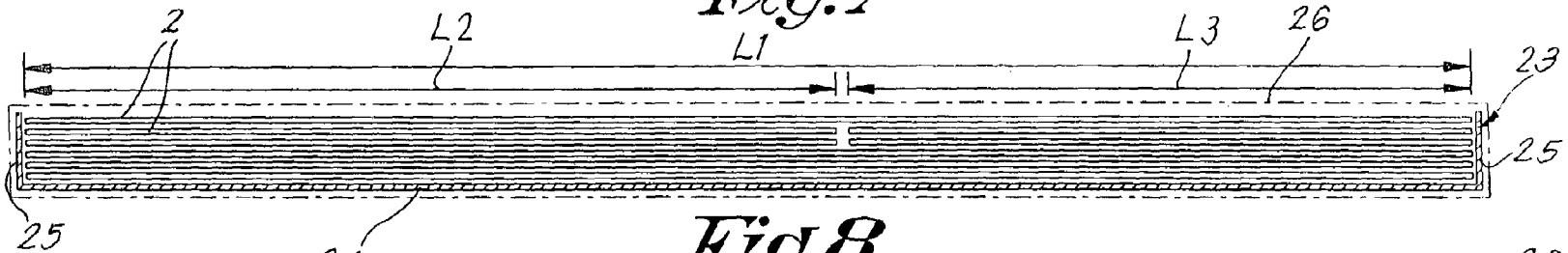
FIGS. 8 and 9 relate to specific methods for packaging floor panels.
Figure 9:
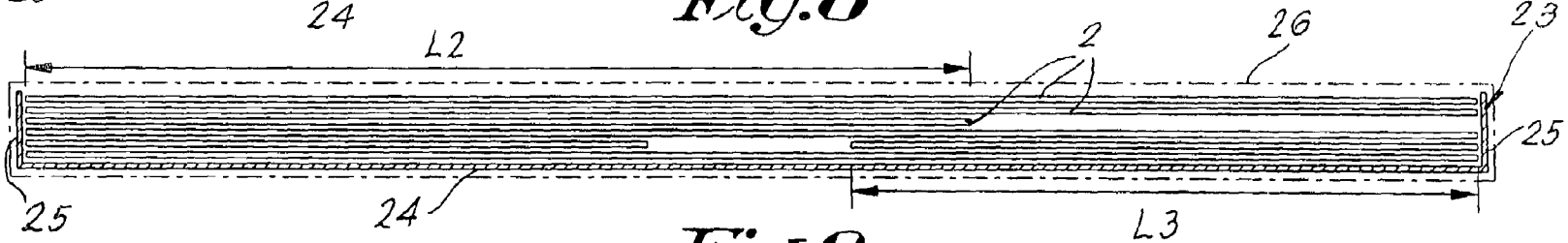

In FIGS. 8 and 9, the method for packaging such floor panels 2, which already has been explained in the introduction is schematically exemplified.

The particularity thereby consists in that floor panels 2 of different lengths, in this case three lengths L1-L2-L3, are provided in one and the same package, more particularly in one and the same box 23, in this case a cardboard box with a bottom 24 and side walls 25, whereby a plastic film 26, for example, shrinking plastic, is provided around this box, which offers the advantages mentioned in the introduction.

Hereby, the floor panels 2, as represented, preferably are stacked flat in the box 23, whereby the panels are provided therein in such a manner that they never can tilt in a horizontal position of the box 23. Namely, the tilting might render packaging more difficult. Such floor panels 2 mostly are successively brought into a box 23 from a transport conveyor, and when floor panels 2 would tilt, they would protrude from the box 23, thereby rendering the provision of the plastic film 26 more difficult.

FIG. 8 shows a manner of packaging whereby the flooring parts of the lengths L2 and L3 are situated next to each other, such that the flooring parts of the length L1, situated thereabove, are well supported.

Generally, it is preferred that the length ratios of the panels are chosen such that the length of the largest panel corresponds or approximately corresponds to the sum of lengths of two or more shorter panels, as is clear from FIG. 8, or that the sum of lengths of a certain combination of panels corresponds to the sum of lengths of another combination of panels. This is advantageous for packaging the panels as well as for cutting them out of plates.

FIG. 9 shows a manner of packaging whereby the lengths L2 and L3 do not allow to provide two floor panels 2 of those lengths next to each other. The stacking then is performed such that here, too, the uppermost floor panels 2 remain flat.

As is also represented in FIGS. 8 and 9, the uppermost floor panel 2 from the box 23 preferably shall be a floor panel 2 of the largest length L1, as a result of which is avoided that a floor panel 2 which could be shifted in the package is present directly below the plastic film 25, which panel, when handling such box 23, might shift and therefore tear open the plastic film 25.

The present invention is in no way limited to the forms of embodiment described by way of example and represented in the figures, however, such floor covering, floor panels, sets of floor panels, method for packaging floor panels and method for manufacturing floor panels can be realized according to different variants, without leaving the scope of the invention. For example, the panels may or may not be provided with bevels or other profiles obtained by removing material from the upper edge, this at one, two, thee or all four upper edges of the panels. The fact that the floor covering of the invention consists of panels of different lengths, means that important portions of the floor covering are formed by such panels and does not exclude that other types or forms of panels can be inserted in the floor covering.

The invention claimed is:

1. A plurality of individual floor panels configured for forming a floor covering, the plurality of individual floor panels comprising at least three types of floor panels each having substantially different common lengths, the individual panels each defining a generally rectangular, strip shaped hard floor panel with mechanical coupling parts defined along each of four edges of the panel and a display feature comprising a wood pattern provided as one continuous pattern over at least an upper surface of the individual floor panel, the type of panel being defined by a corresponding common length;

wherein at least two of the coupling parts located on opposed edges of each of the panels are arranged for locking in both vertical and horizontal directions for forming the floor covering; and wherein the display feature of each of the panels includes at least one paper layer soaked in resin having the wood pattern.

2. The plurality of floor panels according to claim 1, wherein a first type of the floor panels defines a first length that is longer than a length of each of the other types of floor panels, the quantity of the floor panels belonging to the first type outnumber the quantity of floor panels for each other type.

3. The plurality of floor panels according to claim 1, wherein the floor panels of a longest length have a length that is at least eight times their width.

4. The plurality of floor panels according to claim 1, wherein the floor panels of the at least three types have a common width.

5. The plurality of floor panels according to claim 4, further comprising a fourth type of floor panels that are defined as having a width different from the first, second and third types of floor panels.

6. The plurality of floor panels according to claim 1, wherein the floor panels of a first type define a first width and a first length different from a second width and a second length defined by a second type of floor panels.

7. The plurality of floor panels according to claim 1, consisting of only three types of floor panels, each type of floor panel defining a common length different from a length of the other two types of floor panels.

8. The plurality of floor panels according to claim 7, wherein first, second and third types of the floor panels define first, second and third lengths, respectively, the second length and the third length having a combined length generally equaling in length to the first length.

9. The plurality of floor panels according to claim 1, wherein all four coupling parts of each of the floor panels are arranged for locking in both horizontal and vertical directions with other floor panels.

* * * * *